US005464093A

United States Patent [19]

Hogan

[11] Patent Number: 5,464,093

[45] Date of Patent: Nov. 7, 1995

[54] TOBACCO PACKAGE WITH DISPOSAL POUCH

[76] Inventor: Sherman D. Hogan, 1882 S. West Temple, No. 150B, Salt lake City, Utah 84115

[21] Appl. No.: 367,898

[22] Filed: Jan. 3, 1995

[51] Int. Cl.[6] ..... A24F 15/00; B65D 85/10

[52] U.S. Cl. ..... 206/265; 206/242; 206/246; 206/256; 206/260; 206/268; 220/403; 229/160.1

[58] Field of Search ..... 206/265, 269, 206/242, 246, 244, 256, 258, 260, 268, 271; 220/403; 229/160.1

[56] References Cited

U.S. PATENT DOCUMENTS

| | | | |
|---|---|---|---|
| Re. 31,076 | 11/1982 | Herman | 206/246 |
| 1,280,383 | 10/1918 | Campbell | 206/265 X |
| 1,292,628 | 1/1919 | Mortenson | 206/265 X |
| 1,297,831 | 3/1919 | Gilbert | 206/246 X |
| 1,574,566 | 2/1926 | Fiske | 206/265 |
| 1,848,652 | 3/1932 | Pence | 206/269 X |
| 4,172,520 | 10/1979 | Gero | 206/265 |
| 5,014,872 | 5/1991 | Robbins, III | 220/403 |
| 5,074,412 | 12/1991 | White | 206/256 |
| 5,277,304 | 12/1991 | Brizzi et al. | 206/256 |

*Primary Examiner*—Paul T. Sewell
*Assistant Examiner*—Tara L. Laster

[57] ABSTRACT

A package for cigarettes comprising an outer housing and a partitioned pouch fitted into the outer housing so that the front wall of the housing the bottom of the housing and spaced apart end walls of the housing form a forst compartment in which cigarettes are placed and means to releasably seal said first compartment and with the rear wall, bottom and end walls of the outer housing forming a second releasably sealed compartment to receive articles placed therein for storage.

5 Claims, 2 Drawing Sheets

TOBACCO PACKAGE WITH DISPOSAL POUCH

BACKGROUND OF THE INVENTION

1. Field of the Invention

This invention relates to tobacco packages and particularly to re-sealable packages for tobacco products that include a storage compartment for waste products and the like.

2. State of the Art

Tobacco products such as cigarettes are commonly packaged in soft-walled or hard-walled packages, with the cigarettes arranged in side-by-side rows. It is not uncommon for the cigarettes to be partially encased in a foil-backed, paper packet with a fold-over flap overlying the ends of the cigarettes at the end of the package to be opened and with a sealed cellophane outer cover to insure freshness of the package contents.

Access to the contents of the conventional cigarette package is by tearing away the cellophane outer cover; opening an end cover of the package; and lifting of the folded-over foil-backed paper flap.

Once the cellophane outer cover is breached there is no freshness protection for the cigarettes contained in the package and they are exposed to the atmosphere.

Generally, a cigarette user will smoke the cigarettes at a sufficiently fast rate that freshness protection, after the cellophane outer cover has been breached, is not of concern. On occasion, however, and sometimes depending on the atmospheric conditions, the rate of use, and other parameters, it is desirable that freshness can be maintained for longer periods of time than can be presently obtained, once the package has been opened to provide access to the cigarettes contained therein. Also, there are times when the user desires to re-seal the cigarette package to prevent loss of the cigarette contents and/or to prevent damage to the package contents or to the environment. A fisherman, for example, does not want to lose cigarettes in a stream or lake where they will pollute the waters, and much prefers having a re-sealed package that will float, protect the package contents and be easily recovered, if it falls into the water.

In addition, users of tobacco products are often considered to be environmentally irresponsible since all or parts of the cellophane wrappers for packages of cigarettes as well as used matches and the cigarette butts and cigarette filters remaining after cigarettes have been smoked are all too frequently discarded by merely throwing them to the ground at the time of their use, no matter where the user happens to be at that time.

OBJECTS OF THE INVENTION

It is a principle object of the present invention to provide a re-sealable package for tobacco products, such as cigarettes, that will allow a user to maintain content product freshness, even after the package has been breached to provide access to the contents of the package. The re-sealed package will also float to reduce pollution of waters.

It is another principal object of the present invention to provide a package for tobacco products, such as cigarettes that includes a pouch into which items related to the use of the tobacco products can be placed, for convenient later discard of all of the related items along with the package after the originally contained cigarette items have been removed from the package.

FEATURES OF THE INVENTION

To achieve the objects set forth the tobacco package of the invention includes an outer housing, which may comprise the usual soft paper housing or usual hard box housing common to the packaging of cigarettes.

A partitioned pouch is formed from a suitable material, such as the flexible foil-backed paper presently used as a liner in cigarette packages and is inserted into the outer housing. The pouch has spaced apart front and rear walls interconnected by spaced apart side walls that fit against corresponding walls of the outer housing. A partition wall extends from end wall to end wall of the pouch, between and spaced from each of the front and rear walls and is sealed to a bottom of the pouch that interconnects the front and rear and end walls. When the pouch is inserted into an outer housing the bottom of the pouch overlies a corresponding bottom of the outer housing.

The front wall has an upper edge with a bead therealong that will extend over cigarettes placed in rows in the pouch between the partition and the front wall, to fit into a groove formed in one face of the partition. Similarly, the rear wall has an upper edge with a bead therealong that will fit into a groove formed on the opposite face of the partition.

In practice, the pouch is placed in the outer package, cigarettes are placed in the pouch, between the front wall and the partition, and the bead on the front wall is locked into the groove provided therefor in the partition. The outer package is sealed in the usual manner, with the pouch therein. If desired a cellophane wrap can be used around the outer package, but such wrap is not necessary inasmuch as the cigarettes are sealed for freshness within the pouch.

Cigarettes (or other tobacco products, such as cigars) are removed from the package of the invention by first fully or partially removing the cellophane wrap, if one is used; opening an end of the outer package; and separating the bead on the front wall of the pouch from the groove on the partition. As each cigarette is removed the pouch may be re-sealed to extend freshness of the remaining cigarettes and to make the package flotable, by again placing the bead on the front wall in the groove provided therefor in the partition.

As each item associated with smoking is ready to be discarded it may be inserted in the pouch, between the rear wall and the partition. Thus, the partial or full removed cellophane wrap may be inserted, the spent matches used to light the cigarettes and the cigarette butts and/or filters remaining after smoking of the cigarettes may all be placed in the pouch to be discarded after all cigarettes have been removed. The bead on the rear wall is sealed into the groove provided therefor in the partition to hold the discarded items in the pouch, for final discard with the package. It should also be apparent that the pouch can also be used for storage of other items. For example, coins, keys, identification cards, and the like can be stored. This allows a person involved in activities where it is desirable to carry only limited items to carry a package of cigarettes and other items that will fit in the pouch. Thus, for example, a person going to a swimming pool, may carry cigarettes, matches and a key in a cigarette package of the invention.

Additional objects and features will become apparent to those skilled in the art to which the invention pertains from the following detailed description, the claims and the drawings.

THE DRAWINGS

DETAILED DESCRIPTION OF THE INVENTION

Figure 1:
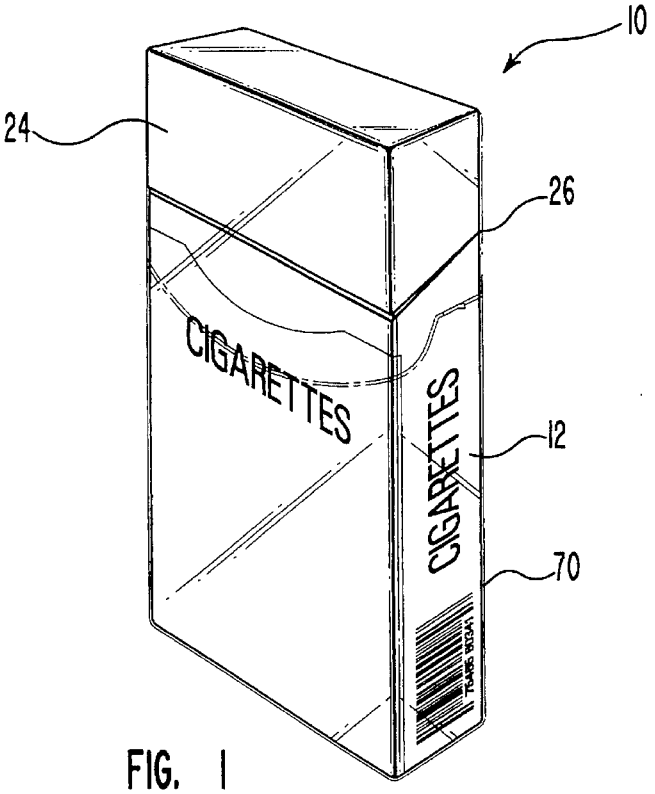
FIG. 1 is a perspective view of a closed and sealed package of the invention, containing cigarettes.
Figure 2:
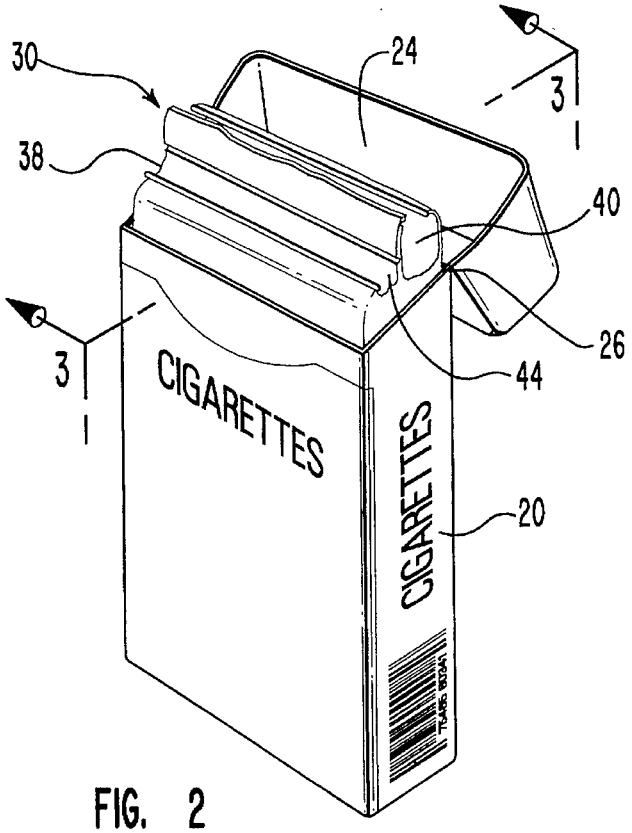
FIG. 2, is a similar view of the package of FIG. 1, with the exterior cellophane wrap removed and the top of the outer package removed.
Figure 3:
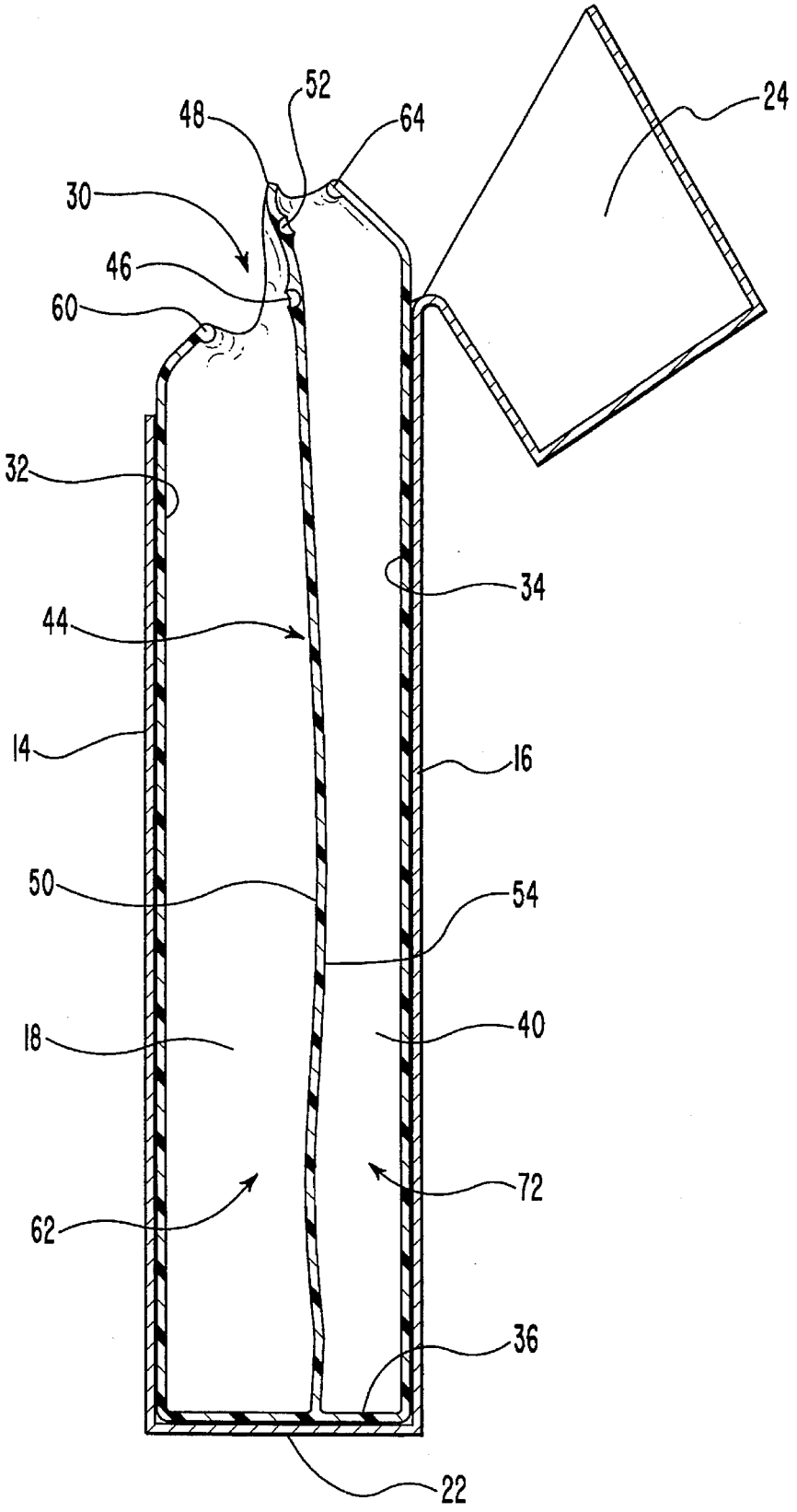
FIG. 3, a vertical section taken on the line 3—3 of FIG. 2.

Referring now to the drawings:

In the illustrated preferred embodiment the package of the invention is shown generally at 10. Package 10 includes an outer housing 12 (here shown as a conventional "hard-box" housing, but that could as well be a conventional "soft" housing) having spaced apart front and rear walls 14 and 16 interconnected by spaced apart end walls 18 and 20. A bottom 22 interconnects the front, rear and side walls and a lid 24 hinged at 26 to the rear wall is opened to provide access to the interior of the housing 12.

A partitioned pouch 30 fits inside the housing 12. Pouch 30 includes spaced apart front and rear walls 32 and 34, respectively. A bottom 36 interconnects the front and rear walls 32 and 34 and the pair of spaced apart end walls 38 and 40. Bottom 36 of the pouch 30 overlies bottom 22 of the housing and walls 32, 34, 38, and 40 of the pouch are positioned against the walls 14, 16, 18 and 20 of the outer housing 12.

A partition wall 44 is fixed along the bottom 36 of the pouch and to each of the end walls 38 and 40. The partition wall has a groove 46 formed adjacent a top edge 48 and in one face 50 of the partition wall. Another groove 52 is provided in the opposite face 54 of the partition wall 44, adjacent to the top edge 48. Both grooves 46 and 52 extend from end wall 38 to end wall 40.

A bead 60, formed along the entire top edge of front wall 32, fits tightly into groove 46 to thereby provide a seal over the top of rows of cigarettes placed in the compartment 62 formed by the front wall 32, end walls 38 and 40, and the partition wall 44. The cigarette contents are thus sealed, locked-in and protected against exterior atmospheric conditions whenever the bead 60 is positioned in groove 46.

Another bead 64 formed along the entire upper edge of rear wall 34 will fit into the groove 52 of the partition wall 44.

In practice, the pouch 30 is placed in the outer housing 12 and may be spot glued in place. Rows of cigarettes (not shown) are placed in the compartment 62 and the lid 24 is closed. The usual cellophane outer wrap 70 is sealed around the outer housing, in customary fashion. The package 10 is then ready for marketing.

Even when the cellophane outer wrap is torn or partially removed, whether or not the lid 24 is opened, the cigarettes are maintained fresh, so long as the seal formed by the bead 60 interlocking with groove 46 is maintained. If the user breaks the seal formed by the interlocking bead 60 and groove 46 to remove a cigarette, or cigarettes, the seal can be reestablished by again placing the bead in the seal. This insures that maximum freshness of the package contents can be maintained and that the package contents are protected against falling out of the package.

Once the cellophane wrap 70 is breached and lid 24 is opened the user can place articles in the compartment 72 of pouch 30. Compartment 72 is formed by partition wall 44, rear wall 34 and end walls 38 and 40 and may be sealed, and re-sealed by the user forcing bead 64 into groove 52. Compartment 72 thus provides a handy receptacle for the removed cellophane outer wrap 70, matches to be used in lighting the cigarettes in the package, both before and after the matches have been used, and cigarette butts and filters remaining after cigarettes from the package have been used. As previously noted, other articles may also be conveniently placed in the compartment 72, if desired.

Although a preferred embodiment of my invention has been herein described, it is to be understood that the present disclosure is by way of example and that variations are possible without departing from the subject matter coming within the scope of the following claims, which subject matter is regarded as the invention.

I claim:

1. A package for cigarettes and the like comprising an outer housing having spaced apart front and rear walls, a bottom interconnecting said front and rear walls and a pair of spaced apart end walls, and a lid connected to one of said walls and pivotable to fit over said other walls;

a pouch in said outer housing and having a bottom overlying said bottom of said outer housing, and front, rear and spaced apart end walls positioned respectively adjacent to said front, rear and end walls of said outer housing; and a partition in said pouch separating said front and rear walls of said pouch and extending between said end walls of said pouch;

means for releasably sealing an upper edge of said front wall to one face of said partition;

means for releasably sealing an upper edge of said rear wall to an opposite face of said partition.

2. A package for cigarettes and the like as in claim 1, wherein said means for releasably sealing an upper edge of said front wall to one face of said partition comprises a groove formed in said face of said partition and extending between said end walls adjacent a top edge of said partition; and a bead formed on a top edge of said front wall, said bead fitting snugly but removably into said groove formed on said one face of said partition.

3. A package for cigarettes and the like as in claim 1, wherein said means for releasably sealing an upper edge of said rear wall to an opposite face of said partition comprises a groove formed in an opposite face of said partition adjacent to an upper edge of said partition; and a bead formed on a top edge of said rear wall, said bead fitting snugly but removably into said groove formed in an opposite face of said partition.

4. A package for cigarettes and the like as in claim 2, wherein said means for releasably sealing an upper edge of said rear wall to an opposite face of said partition comprises a groove formed in an opposite face of said partition adjacent to an upper edge of said partition; and a bead formed on a top edge of said rear wall, said bead fitting snugly but removably into said groove formed in an opposite face of said partition.

5. A package for cigarettes and the like as in claim 4, further including a cellophane wrap sealingly enclosing said outer housing.

* * * * *